US005148374A

United States Patent [19]

Coellner

[11] Patent Number: 5,148,374

[45] Date of Patent: Sep. 15, 1992

[54] DESICCANT SPACE CONDITIONING CONTROL SYSTEM AND METHOD

[75] Inventor: James A. Coellner, Philadelphia, Pa.

[73] Assignee: ICC Technologies, Inc., Philadelphia, Pa.

[21] Appl. No.: 540,547

[22] Filed: Jun. 19, 1990

[51] Int. Cl.[5] ..... A01D 43/02

[52] U.S. Cl. ..... 364/505; 73/168; 55/163

[58] Field of Search ..... 364/510, 551.01, 505; 55/390, 163, 161, 160; 73/168

[56] References Cited

U.S. PATENT DOCUMENTS 4,519,540 5/1985 Boulle et al. ..... 237/7
4,546,442 10/1985 Tinker ..... 364/500
4,701,189 10/1987 Oliker ..... 55/34
4,717,396 1/1988 Stengile et al. ..... 55/20
4,729,774 3/1988 Cohen et al. ..... 55/181
4,769,053 9/1988 Fischer, Jr. ..... 55/389
4,873,649 10/1989 Grald et al. ..... 364/505
4,895,580 1/1990 Morioka et al. ..... 55/160
4,926,618 5/1990 Ratliff ..... 55/20
4,927,434 5/1990 Cordes et al. ..... 55/20

*Primary Examiner*—Parshotam S. Lall
*Assistant Examiner*—S. A. Melnick
*Attorney, Agent, or Firm*—L. A. Husick

[57] ABSTRACT

A system and method for real-time computer control of multi-wheel sorbent mass and energy transfer systems by optimization of calculated mass transfer ratios and measures of system effectiveness which are not subject to long system time constants.

12 Claims, 3 Drawing Sheets

DESICCANT SPACE CONDITIONING CONTROL SYSTEM AND METHOD

BACKGROUND OF THE INVENTION

Regenerative type periodic flow devices are conventionally employed for the transfer of heat or of other constituents from one fluid stream to another, and thereby from one area or zone in space to another. Typically, a sorptive mass is used to collect heat or a particular mass component from one fluid stream which flows over or through the sorptive mass. The flowing fluid is rendered either cooler (in the case of heat sorption) or less concentrated (in the case of, for instance, adsorption of particular gases). The sorptive mass is then taken "off-stream" and regenerated by exposure to a second fluid stream which is capable of accepting the heat or material desorbed with favorable energetics.

In many instances, the sorptive material is contained within a vessel or distributed within a bed structure. It is desirable that such material is provided with maximum surface area, and that fluid flows through the sorptive material matrix be smooth (non-turbulent) and regular. Once the sorptive material has been saturated (i.e. has reached its maximum designed capacity for sorption), the vessel or bed is then removed from the fluid flow path and exposed to a second fluid flow to regenerate the sorptive capacity of the material by, for instance, cooling the sorptive material or desorbing material taken up during "on-stream" operation. After such regeneration, the sorptive material is once more placed back "on-stream" and the operation continues.

From such single cycle systems evolved multiple vessel systems which permitted semi-continuous (or semi-batch) operation by synchronously alternating two or more sorptive vessels between on-stream and off-stream operation. The choice of numbers of vessels and cycle structures depends on many factors, but most importantly the ratio between consumption rate of the sorptive capacity of the vessel, and regeneration rates for that same vessel.

In some applications, semi-continuous systems have evolved into continuous flow systems where the sorptive media itself is moved between two or more flowing fluid streams. The most common construction employed for such systems is a porous disk, often referred to as a wheel or rotor. In its simplest form, such a wheel is divided into two flow zones, and fluid is passed over the sorptive surface of the wheel (typically flowing through the thickness of the disc parallel to the rotational axis of the cylinder) as the wheel is rotated to carry the sorptive material from one zone, into the other, and back again to complete a revolution. In a heat exchanger wheel, for instance, one zone of warm fluid and one zone of cooler fluid are present. Heat is adsorbed by the material of the wheel in the warm flow zone, and is carried away from the wheel as the sorptive material passes through the cool flow zone.

Typically wheel systems are designed according to predefined parameters including known fluid characteristics, known flow rates, known temperatures/concentrations, known and preselected sorptive characteristics (sorption constants and capacities), known wheel geometry, and preselected wheel rotational speeds. Although designed for a particular set of characteristic operating conditions, wheel system manufacturers typically provide information about operation at other conditions. This information is typically derived empirically for a given system and the relationships identified by such methods are valid only over very limited ranges of conditions. For a given system, there is no available means which permits optimization of performance (as either capacity or efficiency) over a wide range of operational conditions.

There have been attempts to employ closed-loop control systems to adjust the operation of wheel sorption systems to changing operating conditions. These prior art systems have been unsuccessful primarily due to the large time constants of the physical systems themselves. The time constant of such a system is a measure of the amount of time required for the system to achieve a steady state after a change in conditions or operating parameters. For example, for a typical air to air heat exchanger system, the time constant may be on the order of 75 seconds. However, for a desiccant/water vapor mass exchanger, the time constant may well exceed 75 minutes. In typical control systems which control operational parameters such as wheel rotational speed based on uncontrolled independent ambient conditions, response times tend to promote over control of the system and tend to destroy stability. For systems incorporating appropriate integration time constants, the ability of the system to react to changing conditions is so limited as to negate any effect of the control system on the efficiency of the system.

BRIEF DESCRIPTION OF THE INVENTION

The system and method of the present invention comprises a control system based upon a predictive closed loop control method which predicts the performance of a sorptive wheel based upon a calculated measure of "transfer effectiveness". For heat exchanger systems, transfer effectiveness may be defined as the ratio of heat transfer rate to the theoretical maximum rate of heat transfer for a given system. For mass transfer systems, similar non-dimensional ratios may be analogized, and an effectiveness may be calculated. From calculated transfer effectiveness values, performance of a given system may be accurately predicted, and control strategies which optimize one or more aspects of system operation may be implemented.

In the preferred embodiment of the present invention, a desiccant/water vapor exchange system for providing cool, dry air to an enclosed space (the "conditioned space") such as a supermarket or shopping mall is comprised of desiccant/water vapor exchangers (which are preferably multi-wheel systems), coupled with cogeneration apparatus which provides both electrical power for consumption within the conditioned space and by the space conditioning system itself, as well as a source of heat energy for use in regeneration of the desiccant medium.

DETAILED DESCRIPTION OF THE INVENTION

Figure 1:
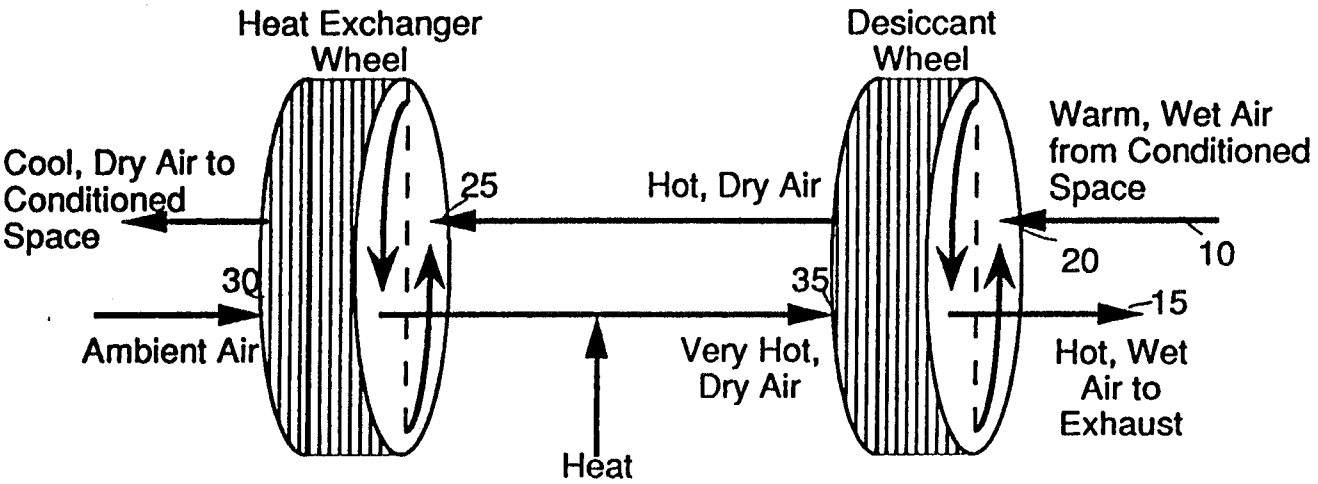
FIG. 1 depicts a schematic representation of a desiccant/water vapor exchange space conditioning system of the present invention.

Referring now to FIG. 1 there is shown in schematic form a multi wheel desiccant/water vapor exchange system which may be controlled according to the present invention. Two air flow paths are defined through the system, one of which is air taken from an enclosed conditioned space. This air stream will typically contain large amounts of water vapor and will be warmer than the desired temperature at which the conditioned space is to be maintained. In a supermarket, for instance, evaporation of water from goods, and exhaled and perspired moisture contribute to high humidity. Operation of refrigeration equipment, lights, and other machinery, as well as heat given off by humans raise the temperature as well.

Typical direct expansion types of space conditioning systems use evaporator coils to both condense moisture from the air stream (the latent load), and to cool the airstream (the sensible load). Such systems typically use chlorofluorocarbon (CFC) refrigerants which are now known to be harmful to the environment. In contrast to the direct expansion systems of the prior art, there have been employed desiccant systems which first adsorb water vapor from the air stream using an inorganic material with a high K value for more hydrated states. After adsorption of water vapor (an exothermic process which yields dry, but extremely hot air), a cooling step is required which may be carried out using a heat exchanger to recover the thermal energy and recycle it for us in regenerating the desiccant by heating to drive off adsorbed water. Properly operated, such a system is capable of delivering relatively cool (78° F.), dry (20gr/lb) air which may be directly returned to the conditioned space or may be further cooled by using small direct expansion or other types of conventional refrigeration systems. The difficulty has been the proper operation of such desiccant systems to maintain efficient operation within constantly changing environmental conditions which vary diurnally and seasonally.

Although the prior art teaches the use of computerized finite element analysis techniques to model the behavior of desiccant mass transfer systems and have claimed good correlation between their predictions and empirically derived observations, such finite element-based systems have been created as developmental tools, and are neither intended nor suited for use as controllers. Such systems are computationally intensive, and require large computer systems for adequate performance in developmental engineering applications. The computational resources required to convert such models into useful real-time controllers renders them unsuitable for use in such applications.

By analogy to the case of heat exchangers, the present invention comprises a control method and system which economically predicts sorptive system behavior and controls such behavior to optimize system performance. The prior art teaches that heat exchanger systems may be characterized by non-dimensional variables known as "number of transfer units or NTU", and "heat capacity ratios". For a given exchanger, performance may be projected based on the ratio of heat transferred (or the rate of heat transfer) to the theoretical maximum amount of heat which can be transferred (or the maximum rate of transfer). Such a ratio is termed the system's "effectiveness".

By analogy, then, a mass transfer system may be characterized by similar non-dimensional variables: number of transfer units may be approximated as the ratio of transfer area to fluid mass flow, capacity ratios may be generalized as the concentration of mass in a fluid and the equilibrium constants governing the behavior of the sorbant, and effectiveness may be calculated. Table I below illustrates the effects of particular operating parameters on these two non-dimensional variables (NTU and Mass Capacity Ratio).

TABLE I

| Operating Parameter (Increased) | Effect on NTU | Effect on Mass Capacity Ratio |
|---|---|---|
| Air Flow | Reduce | Reduce |
| Water Vapor | Increase | Varies |
| Regeneration Temperature | None | Increase |
| Regeneration Fluid Water Vapor Content | None | Reduce |
| Desiccant Concentration | None | Increase |
| Wheel Size | Increase | Increase |
| Rotational Speed | None | Increase |
| Air Temperature | None | Reduce |
| Regeneration Pressure | None | Reduce |

For a given system, the relationships among NTU, mass capacity ratio, and effectiveness are fixed according to design (but may be maximized by adjusting certain design components). The method of the present invention may also be used in the design and implementation of other sorptive systems. The method of the present invention may control certain choices during system design which normally follows the following steps: (i) Definition of the system goals including fluids used, sorbate desired, initial and final sorbate concentrations, and transfer rates; (ii) Selection of sorbant and transfer contact type; (iii) Analysis of design criteria for equipment cost, size, available utilities, and operating costs; (iv) Final System Design.

The designer may use the method of the present invention to determine the impact of design decisions on the ultimate system quickly and accurately. For example, a designer faced with the task of designing a solvent recovery system using a wheel may have as his primary criteria a given recovery rate and low first cost. This designer would therefore wish to choose the smallest possible wheel, reducing cost, with the highest fluid flow rate maximizing transfer rate across the wheel. The method of the present invention would allow the evaluation of various combinations of flow rates and wheel sizes, optimizing operational performance for each combination. It will be recognized by those skilled in the art that the method of the present invention would provide superior results to those available in the prior art: namely, prototype fabrication and testing, or finite element analysis with an extreme number of variables. Table II below presents some of the effects of design choices (based on an application of the method of the present invention) on the design criteria commonly presented to system engineers.

TABLE II

| Design Choice | Effect on 1st Cost | Operating Cost | Capacity | Sorbate Final Concentration |
|---|---|---|---|---|
| Reduce Wheel Diameter | Reduce | Increase | Reduce | Increase |
| Reduce Wheel Depth | Reduce | Reduce | Reduce | Increase |
| Reduce Fluid Flow Rate | None | Reduce | Reduce | Reduce |

TABLE II-continued

| Design Choice | Effect on 1st Cost | Operating Cost | Capacity | Sorbate Final Concentration |
|---|---|---|---|---|
| Reduce Regeneration Temperature | Varies | Varies | Reduce | Increase |

Figure 2:
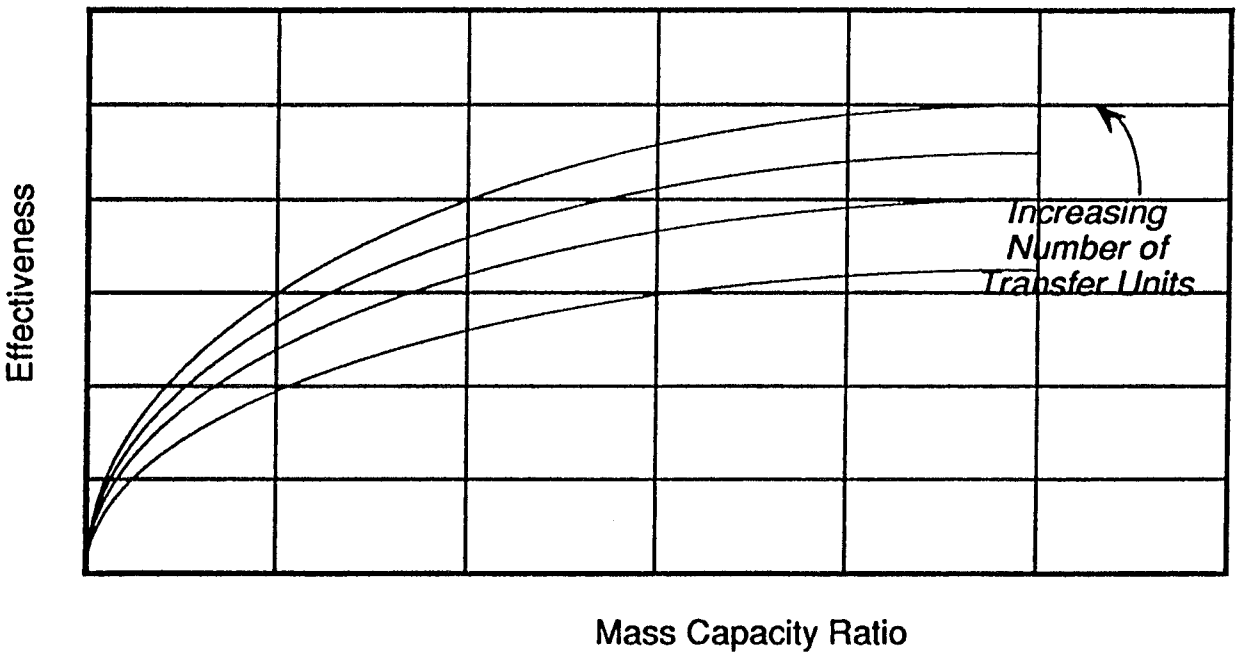
FIG. 2 depicts graphically the relationship between Transfer Effectiveness and the Mass Capacity Ratio for a typical mass transfer sorptive wheel system.
Figure 3:
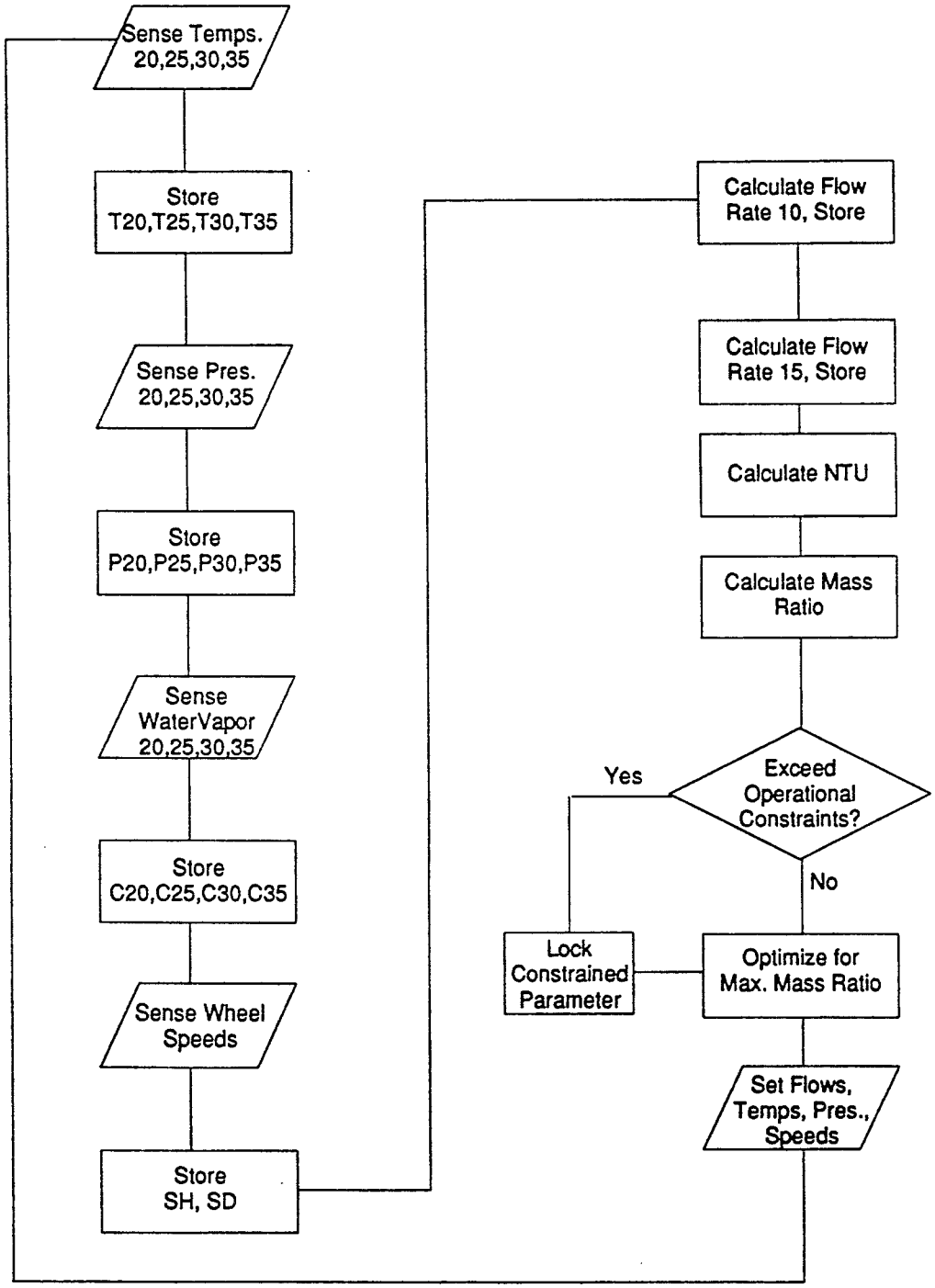
FIG. 3 depicts the computer logic of the present invention in flow chart form.

FIG. 2 illustrates several design relationships graphically. By designing with, for example, maximum wheel size, desiccant concentration on the wheel, and maximum rotational speed (which may, for simple engineering reasons be at odds with increased wheel size and may thus require design comprimise), NTU and mass transfer ratios may be maximized. Of course, other design constraints such as energy consumption, system weight, size, and cost limit such maximization. Because the relationship among NTU, mass capacity ratio and effectiveness may be calculated for a given design, and may be verified empirically, a system to which independent operating parameters are known may optimize certain controlled operating parameters to optimize overall system performance.

Independent operating parameters typically include fluid mass flow rate, fluid concentration, fluid temperature, wheel geometry, and wheel sorbent mass. Controlled parameters of operation typically include regeneration fluid flow rate, regeneration fluid temperature, and wheel rotational speed. By real-time measurement of the independent parameters, and solution of the controlling relationship equations, the dependent parameters may be controlled to optimize system performance for a desired result.

According to the method of the present invention, appropriate sensors are used to measure the temperatures of fluid flowing past four points in the system: desiccant wheel ambient inlet 20, heat exchange wheel hot side inlet 25, heat exchange wheel ambient inlet 30, and desiccant wheel hot air inlet 35. Temperatures may be measured using, for instance, thermistors or similar sensor devices. Fluid flow rates in flow streams 10 and 15 are measured using, for example, wheel pressure differentials sensed at opposing faces of each wheel using conventional pressure sensors such as aneroids or solid state strain gauges. Water vapor concentrations may be measured using conventional sensors at inlets 20, 25, 30 and 35, and may be used to calculate water concentrations of the desiccant medium itself. Finally, wheel speeds for each wheel may be measured by conventional sensors such as frequency detectors or rotational counters.

As described in the pseudocode appendix, measured quantities are converted to controlling variables which are predetermined for each system component. For example, each wheel will have a known relationship of fluid flow to pressure differential, and each component will have design operating constraints such as maximum rotational speeds, temperatures, and the like. After conversion of measured quantities to controlling variables, NTU and capacity ratios are calculated. Since, in general, NTU is only altered by changes in the physical structure of the wheel, it may be calculated only as a check on system operation, and capacity ratios will constitute the principal controlling variable for system performance.

Mass transfer systems of the present invention may transfer materials such as water, organic compounds, Lewis acids and Lewis bases, and other airborne or fluid-borne contaminants using sorptive wheel materials including desiccants such as lithium chloride, silica gel, molecular sieve materials such as natural and synthetic zeolites, chemical sorbents such as activated carbon, and the like.

After determination of capacity ratios, the system calculates optimum settings for regeneration fluid flow rate and temperature as well as wheel rotational speeds, and, within design constraints, adjusts these operating parameters. The system is then monitored until the changing independent parameters again indicate the need for an optimization adjustment. In this way, the system may be continuously and incrementally adjusted without waiting for the system to "settle" over its long time constant.

Optionally, the system and method of the present invention may also control other ancillary systems such as post-conditioning systems, cogeneration systems, air flow controllers, and the like to provide an optimum solution for a multivariable system such as optimization of total energy consumption, within predetermined limits of conditioned space temperature and humidity, or the optimization of conditioned space "humiture" (the physiologically perceived temperature) within predetermined limits of energy consumption.

The system of the present invention may be implemented as a software/hardware system employing a general purpose digital microprocessor such as a Motorola 68030 (optionally used as part of a general purpose computer system, or with such peripheral circuits and interfaces as may be necessary to provide the required signals and storage.) Of course, those skilled in the art will recognize that while the present invention has been described with reference to specific embodiments and applications, the scope of the invention is to be determined solely with reference to the appended claims.

STATEMENT OF INDUSTRIAL UTILITY

The system and method of the present invention may be used in the optimum control of a space conditioning system to reduce or eliminate the use of CFC refrigerants.

PSEUDOCODE APPENDIX

Begin
Sense Fluid Inlet Temperatures 20, 25, 30, 35
Store Sensed Temperatures as Variables T20, T25, T30, T35
Sense Fluid Pressures at Inlets 20, 25, 30, 35
Store Sensed Pressures as Variables P20, P25, P30, P35
Sense Water Vapor Concentrations at Inlet 20, 25, 30, 35
Store Concentrations as Variables C20, C25, C30, C35
Sense Wheel Speeds of Heat Exchanger and Desiccant Wheels
Store Wheel Speed as Variables SH and SD
Calculate Fluid Flow Rate 10 as Lookup value of P20-P25
Store Fluid Flow Rate 10 as Variable R10
Calculate Fluid Flow Rate 15 as Lookup value of P30-P35
Store Fluid Flow Rate 15 as Variable R15
Calculate NTU
Calculate Mass Ratio
Check Operational Constraints
Optimize Set Regeneration Fluid Flow
Set Regeneration Fluid Temperature
Set Regeneration Fluid Pressure
Set Desiccant Wheel Speed
Set Heat Exchanger Wheel Speed
Repeat
End

I claim as my invention:

1. A method for controlling a wheel-based fluid medium mass transfer system having controllable fluid flow rates, controllable regeneration fluid flow temperature, controllable regeneration pressure, and controllable wheel rotational speed, comprising the steps of:

(a) sensing at predetermined intervals a predetermined set of operating parameters selected from the group of wheel inlet temperatures, wheel outlet temperatures, fluid stream flow rates, wheel inlet pressures, wheel outlet pressures, and wheel rotational speeds, to produce signals representative of the physical state of said system;

(b) storing said signals as values in the random access memory of a computer;

(c) calculating at least one mass capacity ratio representative of the physical state and efficiency of said system from said stored values;

(d) storing said mass capacity ratio as a value in the random access memory of a computer;

(e) sending a control signal to a predetermined one of a group of control means which respectively control fluid flow rates, regeneration fluid flow temperature, regeneration pressure, and sorbent wheel rotational speed;

(f) repeating steps (a) through (e) and comparing the later-stored mass capacity ratio to the earlier-stored mass capacity ratio to determine whether said later-stored ratio is greater; and (g) if said later-stored ratio is greater, repeating steps (a) through (f) after said predetermined interval;

(h) if said later-stored ratio is not greater, repeating steps (a) through (f) after said predetermined interval, sending a different control signal in step (e) from that sent in the prior cycle.

2. A method for controlling a wheel-based fluid medium mass transfer system having controllable fluid flow rates, controllable regeneration fluid flow temperature, controllable regeneration pressure, and controllable wheel rotational speed, comprising the steps of:

(a) sensing at predetermined intervals a predetermined set of operating parameters selected from the group of wheel inlet temperatures, wheel outlet temperatures, fluid stream flow rates, wheel inlet pressures, wheel outlet pressures, and wheel rotational speeds, to produce signals representative of the physical state of said system;

(b) storing said signals as values in the random access memory of a computer;

(c) calculating system effectiveness from said stored values;

(d) storing said system effectiveness as a value in the random access memory of a computer;

(e) sending a control signal to a predetermined one of a group of control means which respectively control fluid flow rates, regeneration fluid flow temperature, regeneration pressure, and sorbent wheel rotational speed;

(f) repeating steps (a) through (e) and comparing the later-stored system effectiveness to the earlier-stored system effectiveness to determine whether said later-stored effectiveness is greater; and (g) if said later-stored effectiveness is greater, repeating steps (a) through (f) after said predetermined interval;

(h) if said later-stored effectiveness is not greater, repeating steps (a) through (f) after said predetermined interval, sending a different control signal in step (e) from that sent in the prior cycle.

3. The method of claim 1 or claim 2 wherein said fluid medium is air, and said mass transferred is water.

4. The method of claim 1 or claim 2 wherein said fluid medium is air, and said mass transferred is an organic compound.

5. The method of claim 1 or claim 2 wherein said fluid medium is air, and said mass transferred is a compound selected from the group of Lewis acids and Lewis bases.

6. A system for controlling a wheel-based fluid medium mass transfer system having fluid flow rate control means, regeneration fluid flow temperature control means, regeneration pressure control means, and wheel rotational speed control means, comprising:

(a) sensing means for sensing wheel inlet temperatures, wheel outlet temperatures, fluid stream flow rates, wheel inlet pressures, wheel outlet pressures, and wheel rotational speeds, responsive to timer means;

(b) computer memory means for storing values sensed by said sensor means;

(c) calculating means for calculating system effectiveness from values retreived from said memory means;

(d) control signal generation means responsive to said calculating means; and (e) control means to control fluid flow rates, regeneration fluid flow temperature, regeneration pressure, and sorbent wheel rotational speed; and (f) comparator means for comparing successive system effectiveness values.

7. The system of claim 6 further comprising a wheel having a desiccant material dispersed on its surface.

8. The system of claim 6 further comprising a wheel having a molecular sieve material dispersed on its surface.

9. The system of claim 6 further comprising a wheel having an activated carbon material dispersed on its surface.

10. The system of claim 7 wherein said desiccant is lithium chloride.

11. The system of claim 7 wherein said desiccant is silica gel.

12. The system of claim 8 wherein said molecular sieve is a zeolite.

* * * * *